US005779522A

United States Patent [19]

Walker et al.

[11] Patent Number: 5,779,522

[45] **Date of Patent: *Jul. 14, 1998**

[54] DIRECTIONAL SPRAY PAD SCRUBBER

[75] Inventors: Michael A. Walker; Karl M. Robinson, both of Boise, Id.

[73] Assignee: Micron Technology, Inc., Boise, Id.

[ * ] Notice: The portion of the term of this patent subsequent to Dec. 19, 2015, has been disclaimed.

[21] Appl. No.: 824,664

[22] Filed: Mar. 26, 1997

Related U.S. Application Data

[63] Continuation of Ser. No. 574,678, Dec. 19, 1995, Pat. No. 5,616,069.

[51] Int. Cl.[6] ..... B24B 53/00

[52] U.S. Cl. ..... 451/56; 451/285; 451/287; 451/444; 15/88.1; 134/153; 134/199; 134/143

[58] Field of Search ..... 451/36, 37, 38, 451/285, 287, 288, 443, 444; 15/97.1, 21.1, 77, 88.1, 102; 134/143, 153, 199

[56] References Cited

U.S. PATENT DOCUMENTS

| | | | |
|---|---|---|---|
| 3,031,195 | 4/1962 | Lunsford | 274/9 |
| 4,326,553 | 4/1982 | Hall | 134/153 |
| 4,519,846 | 5/1985 | Aigo | 134/199 |
| 5,154,021 | 10/1992 | Bombardier et al. | 51/262 A |
| 5,216,843 | 6/1993 | Breivogel et al. | 51/131.1 |
| 5,348,033 | 9/1994 | Levit | 134/199 |
| 5,349,978 | 9/1994 | Sago et al. | 134/153 |
| 5,384,986 | 1/1995 | Hirose et al. | 451/444 |
| 5,531,635 | 7/1996 | Mogi et al. | 451/56 |

*Primary Examiner*—Eileen P. Morgan
*Attorney, Agent, or Firm*—Seed and Berry LLP

[57] ABSTRACT

The present invention is a pad scrubber that cleans the planarizing surface of a polishing pad used in CMP processing of semiconductor wafers. The pad scrubber has a fluid manifold, a first nozzle attached to one side of the manifold, and a second nozzle attached to another side of the manifold. The first nozzle directs a first fluid stream generally outwardly toward a peripheral edge of the pad, and the second nozzle directs a second fluid stream generally outwardly to the peripheral edge of the pad and also toward the first fluid stream. The first and second fluid streams converge on the planarizing surface of the pad to separate accumulated waste matter from the polishing pad and to create a contained stream of separated particles that flows across the planarizing surface to the peripheral edge of the pad.

32 Claims, 3 Drawing Sheets

DIRECTIONAL SPRAY PAD SCRUBBER

CROSS-REFERENCE TO RELATED APPLICATION

This application is a continuation of U.S. patent application Ser. No. 08/574,678, filed Dec. 19, 1995 now U.S. Pat. No. 5,616,069.

TECHNICAL FIELD

The present invention relates to an apparatus and method for cleaning polishing pads used for chemical-mechanical planarization of semiconductor wafers, and more specifically for removing waste matter from polishing pads that accumulates on the pad while a wafer is planarized.

BACKGROUND OF THE INVENTION

Chemical-mechanical planarization (CMP) processes planarize the surface of semiconductor wafers to a desired thickness. In a typical CMP process, a wafer attached to a carrier is pressed against a polishing pad in the presence of a slurry. The slurry contains abrasive particles that mechanically remove material from the wafer and chemicals that chemically remove material from the wafer. At least one of the carrier or the pad moves with respect to the other to move the wafer over the pad and gradually planarize the wafer to a desired thickness.

After planarizing a number of wafers, the planarizing surface of a pad degrades and becomes less effective. Planarizing surfaces degrade because waste matter, in the form of particles from the wafer, pad and slurry, accumulates on the planarizing surface of the polishing pad during planarization. The waste matter on the pad reduces the effectiveness and the uniformity of the planarizing surface of the polishing pad. The waste matter accordingly reduces throughput of the CMP process and the uniformity of the polished surface on the wafer. Accordingly, it is necessary to periodically clean the planarizing surface of a polishing pad.

Planarizing surfaces of polishing pads are conventionally cleaned by brushing the pad with a stiff brush, or by flushing the pad with a fluid. One problem with brushing the pad is that the bristles of the brush may abrade the pad surface. Moreover, brushes do not effectively remove the dislodged particles from the surface. Flushing the planarizing surface with a fluid does not abrade the pad, but, because high fluid velocities are required to separate the waste matter from the pad, the dislodged particles of waste matter travel along random trajectories and land on previously cleaned portions of the pad's surface.

SUMMARY OF THE INVENTION

The inventive method and apparatus includes using a pad scrubber to clean the planarizing surface of a polishing pad used in CMP processing of semiconductor wafers. The pad scrubber has a fluid manifold, a first nozzle coupled to the manifold, and a second nozzle coupled to the manifold. The first nozzle directs a first fluid stream generally outwardly toward a periphery of the pad, and the second nozzle directs a second fluid stream toward the first fluid stream and the pad's periphery. The spray nozzles separate the waste matter from the polishing pad and create a contained stream of separated matter that flows toward the periphery of the pad.

DETAILED DESCRIPTION OF THE INVENTION

The present invention provides a pad scrubber that effectively separates and removes waste matter from the planarizing surface of a polishing pad. An important aspect of the invention is to direct fluid streams toward each other and toward the periphery of the pad to separate the waste matter from the planarizing surface and to create a contained stream that removes the separated matter from the pad. The present invention accordingly separates and removes waste matter from the pad without re-contaminating clean portions of the pad or damaging the pad. FIGS. 1–5 illustrate some embodiments of the invention, and like reference numbers refer to like parts throughout the various figures.

Figure 1:
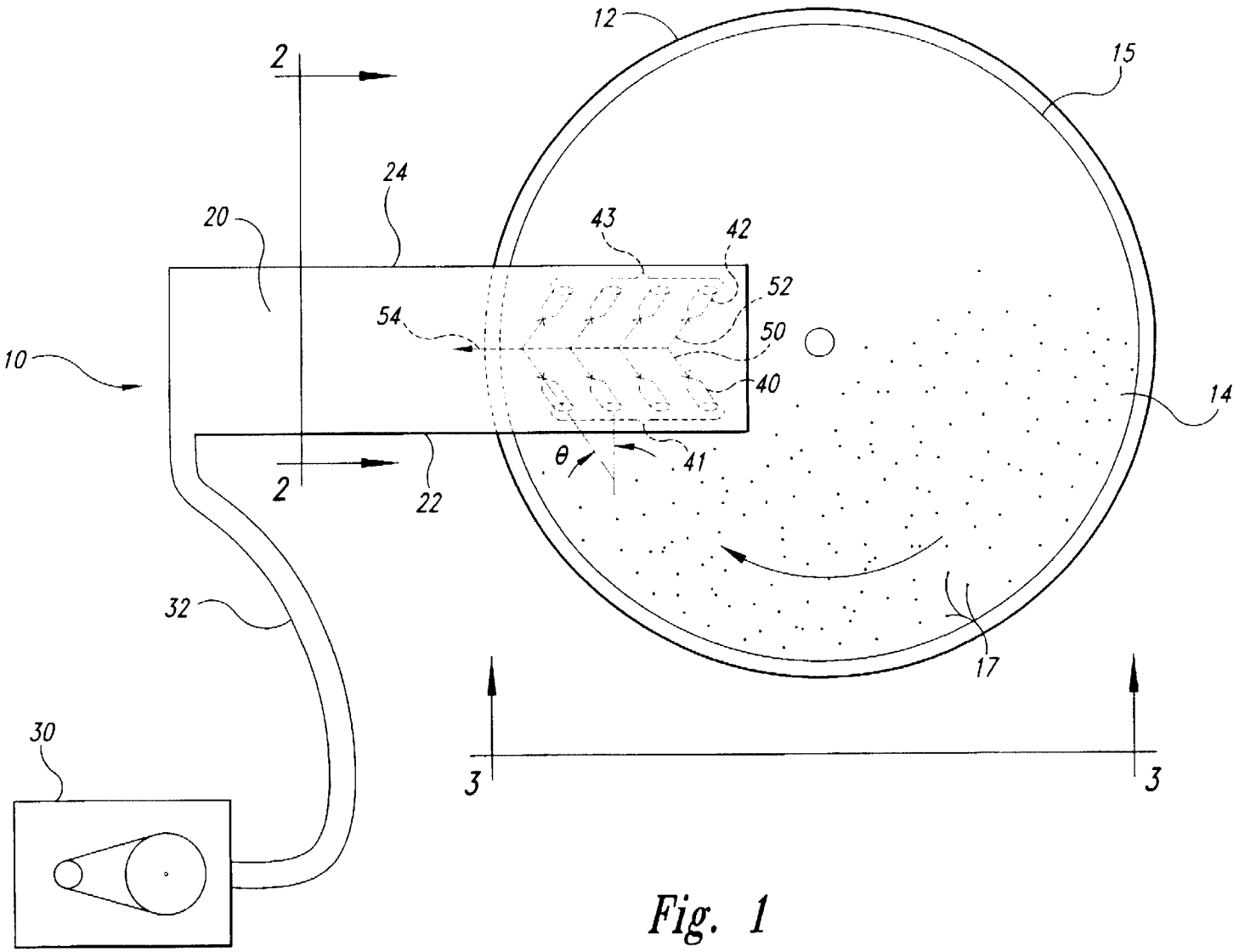
FIG. 1 is a top plan view of a directional spray pad scrubber mounted in place over a polishing pad in accordance with the invention.

FIG. 1 shows a pad scrubber 10, a moveable platen 12, and a polishing pad 14 attached to the platen 12. The pad scrubber 10 is positioned above the platen 12, and it has a manifold 20 connected to fluid supply pump 30 by a hose 32. At least one first nozzle 40 is attached to one side of the manifold 20, and at least one second nozzle 42 is attached to another side of the manifold 20. In a preferred embodiment, a set 41 of the first nozzles 40 are preferably attached to a leading side 22 of the manifold 20 with respect to the rotation of the pad 14, while a set 43 of the second nozzles 42 are attached to a trailing side 24 of the manifold 20. In general, each first nozzle 40 directs a first fluid stream 50, and each second nozzle 42 directs a second fluid stream 52. The first and second fluid streams 50 and 52 converge on the surface of the pad 14 to create a contained fluid stream 54 that flows outwardly across the perimeter 15 of the pad 14 to a drain (not shown).

Figure 2:
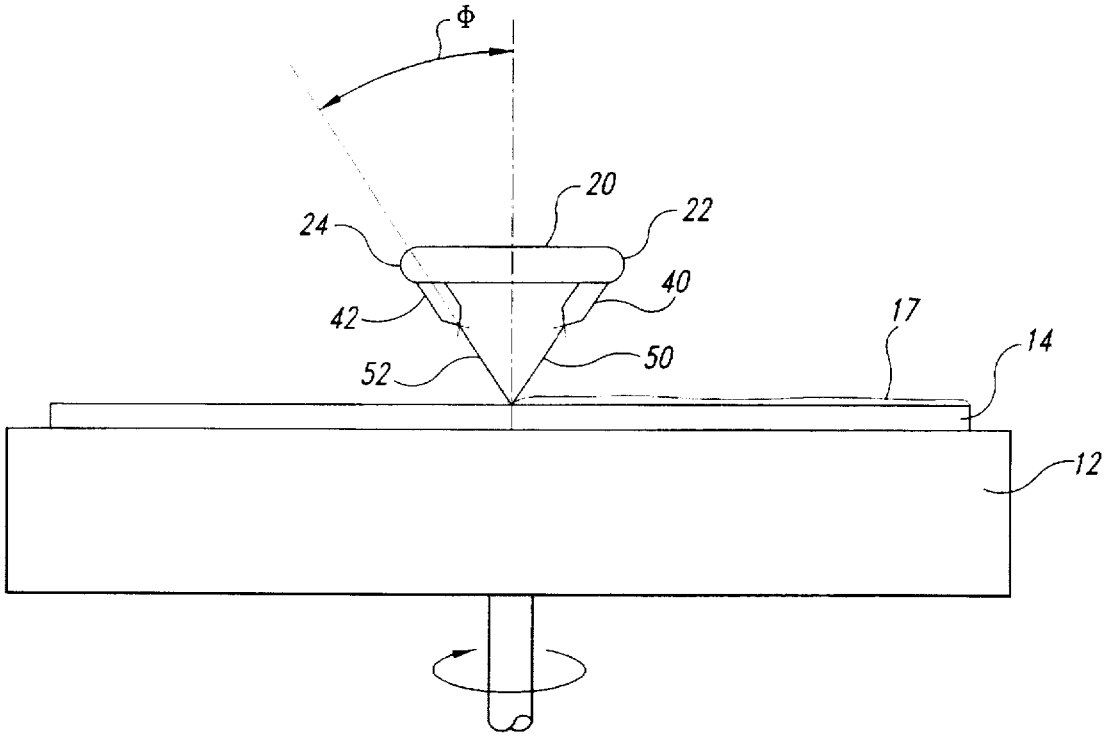
FIG. 2 is a cross-sectional view of the directional spray pad scrubber taken along the line 2—2 of FIG. 1.
Figure 3:
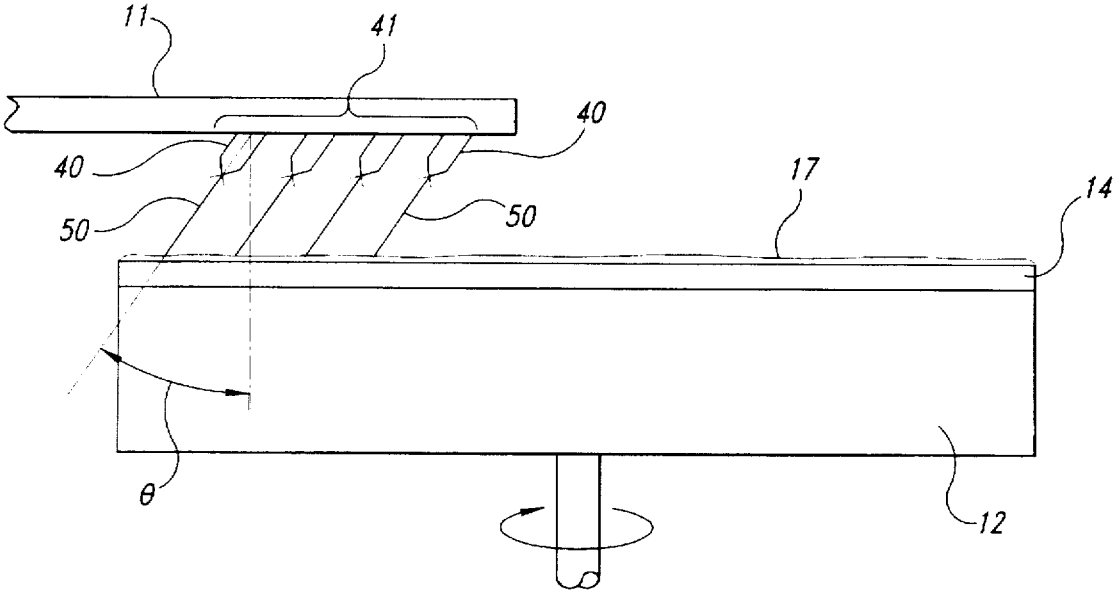
FIG. 3 is a side elevational view of the directional spray pad scrubber taken along the line 3—3 of FIG. 1.

FIGS. 2 and 3 further illustrate the manifold 20 of the pad scrubber 10 shown in FIG. 1. In this embodiment, the manifold 20 is an elongated tube with a flat, oval-shaped cross section through which a cleaning fluid is pumped. The manifold 20 is preferably wide enough to separate the leading side 22 from the trailing side 24 so that the nozzles 40 and 42 are canted towards each other at an angle $\phi$, as shown in FIG. 2. The value of angle $\phi$ is a function of the distance between the outlets of the nozzles, and the distance from the nozzle outlets to the polishing pad 14. The invention, however, is not necessarily limited to a manifold with a specific cross-section and width. A long, narrow pipe with branch lines to which the nozzles are coupled (not shown) may be used to carry the cleaning fluid to the nozzles. The first and second nozzles 40 and 42 are also canted toward the periphery of the pad at an angle $\theta$, as shown in FIG. 3. The value of angles $\phi$ and $\theta$ are generally between 25 and 75 degrees, but angles $\phi$ and $\theta$ may be outside of this range in some embodiments. Each of the nozzles is preferably canted at the same angles $\phi$ and $\theta$, but in other embodiments of the invention the angles of the nozzles may vary from any one nozzle to another. Additionally, although each first nozzle 40 is preferably positioned substantially opposite to a corresponding second nozzle 42, the first nozzles 40 may be staggered with respect to the second nozzles 42 to change the characteristics of the contained stream 54.

In the operation of the pad scrubber 10 shown in FIGS. 1–3, the pump 30 pumps a cleaning fluid through manifold 20 to the first and second nozzles 40 and 42 to produce the first and second fluid stream 50 and 52, respectively. The first and second fluid streams 50 and 52 converge on the polishing pad 14 and separate the waste matter 17 from the pad 14. The first and second fluid streams 50 and 52 also create the contained fluid stream 54 and direct the contained fluid stream 54 outwardly across the periphery 15 of the pad 14. As the contained fluid stream 54 exits the pad 14, it removes the separated waste matter from the pad.

Figure 4:
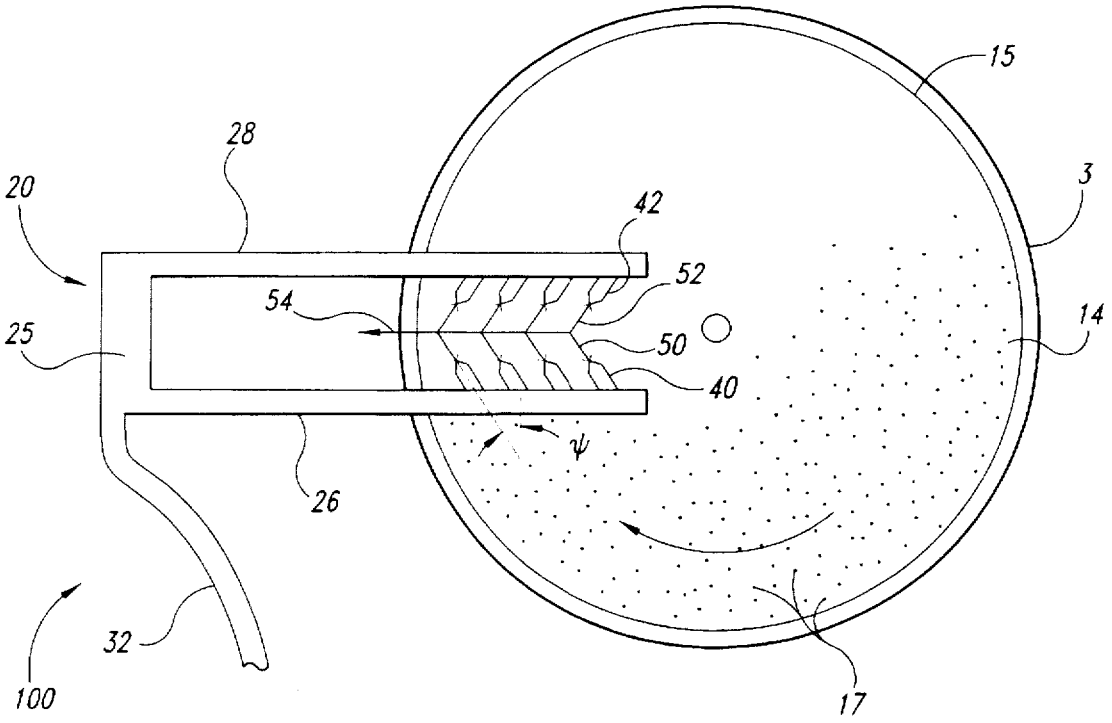
FIG. 4 is a top plan view of another directional spray scrubber in accordance with the invention.

FIG. 4 illustrates another pad scrubber 100 in accordance with the invention in which the manifold 20 has a primary section 25, a first conduit 26 and a second conduit 28. The set of first nozzles 40 is attached to the first conduit 26 and the set of second nozzles 42 is attached to the second conduit 28. The first and second conduits 26 and 28 are preferably spaced apart from one another by a sufficient distance to allow the nozzles to be canted toward one another at a desired angle, as explained above. In operation, the cleaning fluid flows from the primary section 25 through the first and second conduits 26 and 28 to the first and second nozzles 40 and 42, respectively. The first and second nozzles 40 and 42 direct the first and second fluid streams 50 and 52 toward the polishing pad 14. Also as discussed above, the first and second fluid streams 50 and 52 separate the waste matter 17 from the planarizing surface of the pad, and the contained stream 54 removes the separated matter from the pad.

Figure 5:
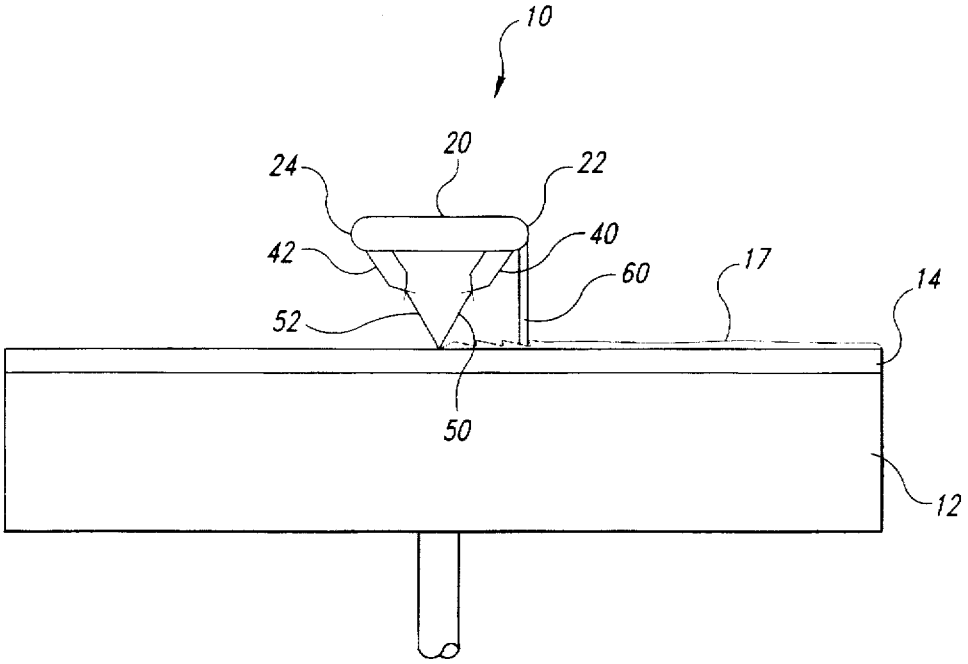
FIG. 5 is a side elevational view of another directional spray pad scrubber in accordance with the invention.

FIG. 5 illustrates another embodiment of the invention with a brush 60 attached to the leading side 22 of the manifold 20. The brush 60 contacts the planarizing surface of the pad 14 and loosens some of the waste matter 17 from the pad. The brush 60 of the invention presses against the pad with less force than conventional brush pad cleaners because most of the particles are separated by the fluid streams 50 and 52. Thus, the brush 60 is less likely to damage the pad than conventional brush pad cleaners. The fluid stream 50 and 52 then separate the loosened particles from the pad 14 and the contained stream 54 removes the particles from the pad.

One advantage of the pad scrubber of the invention is that it substantially prevents previously separated matter from being re-deposited onto the pad. The inventive pad scrubber achieves this advantage because the first and second fluid streams 50 and 52 cant towards one another and toward the periphery of the pad 14 so that the fluid streams 50 and 52 converge together at the planarizing surface of the polishing pad 14 and create the contained steam 54 that flows toward the pad's perimeter. The contained stream 54 substantially prevents separated matter from being randomly re-deposited on previously cleaned areas on the pad, and removes the separated matter from the pad's periphery.

Another advantage of the pad scrubber of the invention is that a brush can be used without damaging the surface of the polishing pad 14. The pad scrubber of the invention achieves this advantage because the first and second fluid streams 50 and 52 separate a significant percentage of the waste matter from the surface of the polishing pad, and thus the brush of the invention presses against the pad 14 with less force than convention brush-only pad scrubbers.

From the foregoing, it will be appreciated that, although embodiments of the invention have been described herein for purposes of illustration, various modifications may be made without deviating from the spirit and scope of the invention. Accordingly, the invention is not limited except by the following claims.

We claim:

1. A chemical-mechanical planarization apparatus, comprising:

a platen;

a polishing pad positioned on the platen, the polishing pad having a planarizing surface;

a wafer carrier positioned over the polishing pad, wherein at least one of the wafer carrier and the platen is moveable with respect to the other to impart relative motion therebetween and planarize a wafer; and a pad scrubber located proximate to the planarizing surface of the polishing pad, the pad scrubber having a fluid manifold, a first nozzle attached to the manifold for directing a first fluid stream generally outwardly toward a peripheral edge of the polishing pad, and a second nozzle attached to the manifold and canted for directing a second fluid stream outwardly toward the peripheral edge of the polishing pad and toward the first fluid stream.

2. The apparatus of claim 1 wherein a plurality of first nozzles are positioned along a leading edge of the manifold and a plurality of second nozzles are positioned along a trailing edge of the manifold, the first nozzles being positioned opposite the second nozzles to form a contained stream at the planarizing surface of the polishing pad.

3. The apparatus of claim 1 wherein a plurality of first nozzles are positioned along a leading edge of the manifold and a plurality of second nozzles are positioned along a trailing edge of the manifold, the first nozzles being positioned opposite the second nozzles to form a contained stream at the planarizing surface of the polishing pad, and the first and second nozzles being canted toward one another at an angle $\Theta$ and toward the peripheral edge of the polishing pad at an angle $\Phi$.

4. The apparatus of claim 3 wherein the angle $\Theta$ is between 20 and 70 degrees with respect to a plane normal to the planarizing surface and the angle $\Phi$ is between 20 and 70 degrees with respect to a plane normal to the planarizing surface.

5. The apparatus of claim 1 wherein the manifold comprises a flat elongated tube having a leading edge and a trailing edge, and wherein a plurality of first nozzles are positioned along the leading edge of the manifold and a plurality of second nozzles are positioned along the trailing edge of the manifold, the first nozzles being positioned opposite the second nozzles to form a contained stream at the planarizing surface of the polishing pad.

6. The apparatus of claim 1, further comprising a brush attached to the pad scrubber for contacting the planarizing surface of the polishing pad.

7. An apparatus for chemical-mechanical planarization of a wafer, comprising:

a platen;

a polishing pad positioned on the platen, the polishing pad having a planarizing surface; and a pad scrubber located proximate to the planarizing surface of the polishing pad, the pad scrubber having a fluid manifold, a plurality of first nozzles attached to the manifold along a leading edge, and a plurality second nozzles attached to the manifold along a trailing edge, wherein the first and second nozzles are canted toward one another at an angle $\Theta$ and toward the peripheral edge of the polishing pad at an angle $\Phi$ to direct first and second streams of fluid onto the planarizing surface of the polishing pad.

8. The apparatus of claim 7 wherein each first nozzle is positioned opposite a second nozzle so that a first fluid stream from the first nozzle and a second fluid stream from the second nozzle intersect one another.

9. The apparatus of claim 7 wherein the angles Θ and Φ direct the first and second fluid streams toward one another to intersect at the planarizing surface of the polishing pad.

10. The apparatus of claim 9 wherein the angle Θ is between 20 and 70 degrees with respect to a plane normal to the planarizing surface and the angle Φ is between 20 and 70 degrees with respect to a plane normal to the planarizing surface.

11. The apparatus of claim 7 wherein the manifold comprises a flat elongated tube, the leading edge extending longitudinally along one side of the tube and the trailing edge extending longitudinally along another side of the tube.

12. A chemical-mechanical planarization apparatus, comprising:

a moveable platen;

a polishing pad positioned on the platen, the polishing pad having a planarizing surface; and a pad scrubber located proximate to the planarizing surface of the polishing pad, the pad scrubber having a fluid manifold, a brush with one end attached to the manifold and another end engaged with the planarizing surface, a first nozzle attached to the manifold for directing a first fluid stream generally outwardly toward a peripheral edge of the polishing pad, and a second nozzle attached to the manifold and canted to direct the second fluid stream generally outwardly toward the peripheral edge of the polishing pad and toward the first fluid stream.

13. The apparatus of claim 12 wherein a plurality of first nozzles are positioned along a leading edge of the manifold and a plurality of second nozzles are positioned along a trailing edge of the manifold, the first nozzles being positioned opposite the second nozzles to form a contained stream at the planarizing surface of the polishing pad.

14. The apparatus of claim 12 wherein a plurality of first nozzles are positioned along a leading edge of the manifold and a plurality of second nozzles are positioned along a trailing edge of the manifold, the first nozzles being positioned opposite the second nozzles to form a contained stream at the planarizing surface of the polishing pad, and the first and second nozzles being canted toward one another at an angle Θ and toward the peripheral edge of the polishing pad at an angle Φ.

15. The apparatus of claim 14 wherein the angle Θ is between 20 and 70 degrees with respect to a plane normal to the planarizing surface and the angle Φ is between 20 and 70 degrees with respect to a plane normal to the planarizing surface.

16. The apparatus of claim 12 wherein the manifold comprises a flat elongated tube having a leading edge and a trailing edge, and wherein a plurality of first nozzles are positioned along the leading edge of the manifold and a plurality of second nozzles are positioned along the trailing edge of the manifold, the first nozzles being positioned opposite the second nozzles to form a contained stream at the planarizing surface of the polishing pad.

17. A polishing pad scrubber for cleaning a planarizing surface of a polishing pad used in chemical-mechanical planarization of substrates, comprising:

a fluid manifold;

a plurality of first nozzles attached to the manifold along a leading edge; and a plurality second nozzles attached to the manifold along a trailing edge, wherein the first and second nozzles are canted toward one another at an angle Θ and toward the peripheral edge of the polishing pad at an angle Φ to direct first and second streams of fluid onto the planarizing surface of the polishing pad.

18. The apparatus of claim 17 wherein each first nozzle is positioned opposite a second nozzle so that a first fluid stream from the first nozzle and a second fluid stream from the second nozzle intersect one another.

19. The apparatus of claim 17 wherein the angles Θ and Φ direct the first and second fluid streams toward one another to intersect at the planarizing surface of the polishing.

20. The apparatus of claim 19 wherein the angle Θ is between 20 and 70 degrees with respect to a plane normal to the planarizing surface and the angle Φ is between 20 and 70 degrees with respect to a plane normal to the planarizing surface.

21. The apparatus of claim 17 wherein the manifold comprises a flat elongated tube, and wherein the leading edge extends longitudinally along one side of the tube and the trailing edge extends longitudinally along another side of the tube.

22. A polishing pad scrubber for cleaning a planarizing surface of a polishing pad used in chemical-mechanical planarization of substrates, comprising:

a fluid manifold;

a brush with one end attached to the manifold and another end engaged with the planarizing surface;

a first nozzle attached to the manifold for directing a first fluid stream generally outwardly toward a peripheral edge of the polishing pad; and a second nozzle attached to the manifold and canted to direct the second fluid stream generally outwardly toward the peripheral edge of the polishing pad and toward the first fluid stream.

23. The apparatus of claim 22 wherein a plurality of first nozzles are positioned along a leading edge of the manifold and a plurality of second nozzles are positioned along a trailing edge of the manifold, the first nozzles being positioned opposite the second nozzles to form a contained stream at the planarizing surface of the polishing pad.

24. The apparatus of claim 22 wherein a plurality of first nozzles are positioned along a leading edge of the manifold and a plurality of second nozzles are positioned along a trailing edge of the manifold, the first nozzles being positioned directly opposite the second nozzles to form a contained stream at the planarizing surface of the polishing pad, and the first and second nozzles being canted toward one another at an angle Θ and toward the peripheral edge of the polishing pad at an angle Φ.

25. The apparatus of claim 24 wherein the angle Θ is between 20 and 70 degrees with respect to a plane normal to the planarizing surface and the angle Φ is between 20 and 70 degrees with respect to a plane normal to the planarizing surface.

26. The apparatus of claim 22 wherein the manifold comprises a flat elongated tube having a leading edge and a trailing edge, and wherein a plurality of first nozzles are positioned along the leading edge of the manifold and a plurality of second nozzles are positioned along the trailing edge of the manifold, the first nozzles being positioned opposite the second nozzles to form a contained stream at the planarizing surface of the polishing pad.

27. A method for cleaning a planarizing surface of a polishing pad, comprising:

directing a first fluid stream onto a planarizing surface of a polishing pad toward a peripheral edge of the polishing pad;

aiming a second fluid stream to impinge the planarizing surface and flow toward the peripheral edge and the first fluid stream, wherein the first and second fluid streams form a combined stream that flows outwardly toward the peripheral edge of the polishing pad.

28. The method of claim 27 wherein:

the act of directing the first fluid stream comprises pumping fluid through a fluid manifold and a plurality of first nozzles attached to the manifold along a leading edge of the manifold; and the act of aiming the second fluid stream comprises pumping fluid through the manifold and a plurality second nozzles attached to the manifold along a trailing edge of the manifold, wherein the first and second nozzles are canted toward one another at an angle Θ and toward the peripheral edge of the polishing pad at an angle Φ to direct the first and second streams of fluid onto the planarizing surface of the polishing pad.

29. The method of claim 28, further comprising configuring each first nozzle to be positioned opposite a second nozzle so that each first fluid stream from each first nozzle intersects a corresponding second fluid stream from an opposing second nozzle.

30. The method of claim 28, further comprising configuring the first and second nozzles so that the angles Θ and Φ direct the first and second fluid streams toward one another to intersect at the planarizing surface of the polishing.

31. The method of claim 30 wherein in the act of configuring comprises making the angle Θ between 20 and 70 degrees with respect to a plane normal to the planarizing surface and making the angle Φ between 20 and 70 degrees with respect to a plane normal to the planarizing surface.

32. A method of planarizing a substrate, comprising:

pressing the substrate against a planarizing surface of a polishing pad;

moving at least one of the substrate and the polishing pad with respect to the other to impart relative motion therebetween and remove material from the substrate;

directing a first fluid stream onto a planarizing surface of a polishing pad toward a peripheral edge of the polishing pad; and aiming a second fluid stream to impinge the planarizing surface and flow toward the peripheral edge and the first fluid stream, wherein the first and second fluid streams form a combined stream that cleans the planarizing surface of the polishing pad and flows outwardly toward the peripheral edge of the polishing pad.

* * * * *

UNITED STATES PATENT AND TRADEMARK OFFICE

CERTIFICATE OF CORRECTION

PATENT NO. : 5,779,522
DATED : July 14, 1998
INVENTOR(S) : Walker et al.

It is certified that error appears in the above-identified patent and that said Letters Patent is hereby corrected as shown below:

Column 6,
Lines 11, 12, "polishing." should be -- polishing pad. --

Signed and Sealed this

Eighth Day of January, 2002

*Attest:*

*Attesting Officer*

JAMES E. ROGAN
*Director of the United States Patent and Trademark Office*